US008474157B2

(12) United States Patent
Motawi et al.

(10) Patent No.: US 8,474,157 B2
(45) Date of Patent: Jul. 2, 2013

(54) FOOTWEAR LACING SYSTEM

(75) Inventors: Wade Motawi, Ladera Ranch, CA (US); James Kim, Newport Beach, CA (US); Greg Fellmer, Ladera Ranch, CA (US)

(73) Assignee: Pierre-Andre Senizergues, Newport Beach, CA (US)

( * ) Notice: Subject to any disclaimer, the term of this patent is extended or adjusted under 35 U.S.C. 154(b) by 846 days.

(21) Appl. No.: 12/537,795

(22) Filed: Aug. 7, 2009

(65) Prior Publication Data

US 2011/0030244 A1 Feb. 10, 2011

(51) Int. Cl.
*A43C 11/00* (2006.01)
*A43B 5/04* (2006.01)

(52) U.S. Cl.
USPC ..... 36/117.1; 36/50.5; 36/50.1

(58) Field of Classification Search
USPC ..... 36/114, 115, 117.1, 117.2, 117.7, 36/50.5, 51
See application file for complete search history.

(56) References Cited

U.S. PATENT DOCUMENTS

| | | | |
|---|---|---|---|
| 375,677 | A | 12/1887 | Kyle |
| 547,424 | A | 10/1895 | Eaton |
| 586,770 | A | 7/1897 | Kempshall |
| 599,906 | A | 3/1898 | Kempshall |
| 654,388 | A | 7/1900 | Diemer |
| 714,191 | A | 11/1902 | Kempshall |
| 737,769 | A | 9/1903 | Preston |
| 267,421 | A | 10/1903 | Cataldi |
| 742,206 | A | 10/1903 | Maurer |
| 795,119 | A | 7/1905 | Harlow |
| 1,053,529 | A | 2/1913 | Neary |
| 1,090,438 | A | 3/1914 | Worth et al. |
| 1,242,774 | A | 10/1917 | Curry |
| 1,246,724 | A | 11/1917 | Daggett |
| 1,282,539 | A | 10/1918 | Carlson et al. |
| 1,292,975 | A | 1/1919 | Valde |
| 1,371,637 | A | 3/1921 | Meredith |
| 1,429,657 | A | 9/1922 | Trawinski |
| 1,466,075 | A | 8/1923 | Triau, Jr. |

(Continued)

FOREIGN PATENT DOCUMENTS

| | | |
|---|---|---|
| AT | 261671 | 4/2004 |
| AT | 354980 | 3/2006 |

(Continued)

OTHER PUBLICATIONS www.mcglassonboots.com; Boot Anatomy; Jul. 31, 2009; 1 page.

(Continued)

*Primary Examiner* — Jila M Mohandesi
(74) *Attorney, Agent, or Firm* — Stetina Brunda Garred & Brucker

(57) ABSTRACT

A snowboard boot having two handles which each handle controlling pressure within two tightening zones is disclosed. One handle may be pitched to adjust pressure within upper and lower shin portion tightening zones. A second handle may be pitched to adjust pressure within upper and lower foot portion tightening zones. Once the appropriate amount of pressure is applied to the various tightening zones, locks may be engaged to set the pressures. The pressures are isolated from each other such that the various different pressures within the various different tightening zones do not equalize but remain constant during the snowboarding session. Additionally, the handles may be stored on a tongue of the snowboard boot or a back portion of the snowboard boot.

5 Claims, 6 Drawing Sheets

U.S. PATENT DOCUMENTS

| | | | |
|---|---|---|---|
| 1,530,713 | A | 3/1925 | Clark |
| 1,608,214 | A | 11/1926 | Janke |
| 2,019,587 | A | 11/1935 | Tyrrell |
| 2,022,554 | A | 11/1935 | Williams |
| 2,109,751 | A | 3/1938 | Matthew et al. |
| 2,284,814 | A | 6/1942 | Rookin |
| 2,345,057 | A | 3/1944 | Marinette |
| 2,674,021 | A | 4/1954 | Cataldi |
| 2,871,537 | A | 2/1959 | Hickerson |
| 3,106,003 | A | 10/1963 | Henderson |
| 3,122,805 | A | 3/1964 | Worth et al. |
| 3,132,394 | A | 5/1964 | Russell |
| 3,176,362 | A | 4/1965 | Tames |
| 3,193,950 | A | 7/1965 | Liou |
| 3,221,384 | A | 12/1965 | Aufenacker |
| 3,229,340 | A | 1/1966 | Herdman |
| 3,239,903 | A | 3/1966 | Steinberg |
| 3,265,032 | A | 8/1966 | Hume |
| 3,321,815 | A | 5/1967 | Herdman |
| 3,333,304 | A | 8/1967 | Daddona, Jr. |
| 3,430,303 | A | 3/1969 | Perrin et al. |
| 3,473,198 | A | 10/1969 | Meier |
| 3,546,796 | A | 12/1970 | Adams |
| 3,574,900 | A | 4/1971 | Emery |
| 3,618,232 | A | 11/1971 | Shnuriwsky |
| 3,631,613 | A | 1/1972 | Brettell |
| 3,703,775 | A | 11/1972 | Gatti |
| 3,710,486 | A | 1/1973 | Revny |
| 3,715,782 | A | 2/1973 | Newell |
| 3,731,350 | A | 5/1973 | Diebold |
| 3,812,811 | A | 5/1974 | Rodriguez |
| 3,834,048 | A | 9/1974 | Maurer |
| 3,908,238 | A | 9/1975 | Panicci |
| 3,934,346 | A | 1/1976 | Sasaki et al. |
| 3,988,810 | A | 11/1976 | Emery |
| 4,081,916 | A | 4/1978 | Salisbury |
| 4,084,532 | A | 4/1978 | Feder |
| 4,120,077 | A | 10/1978 | Fink |
| 4,125,918 | A | 11/1978 | Baumann |
| 4,142,307 | A | 3/1979 | Martin |
| 4,200,998 | A | 5/1980 | Adams |
| 4,227,322 | A | 10/1980 | Annovi |
| 4,245,408 | A | 1/1981 | Larsen et al. |
| 4,261,081 | A | 4/1981 | Lott |
| 4,309,033 | A | 1/1982 | Parker, Jr. et al. |
| 4,333,649 | A | 6/1982 | Vaughn et al. |
| RE31,052 | E | 10/1982 | Adams |
| 4,361,938 | A | 12/1982 | Emery |
| 4,391,049 | A | 7/1983 | Parisotto |
| 4,397,253 | A | 8/1983 | Uecker |
| 4,408,403 | A | 10/1983 | Martin |
| 4,426,756 | A | 1/1984 | Herdman |
| 4,433,456 | A | 2/1984 | Baggio |
| 4,442,613 | A | 4/1984 | Dobbin |
| 4,519,625 | A | 5/1985 | Luitz et al. |
| 4,536,975 | A | 8/1985 | Harrell |
| 4,538,367 | A | 9/1985 | Adams |
| 4,592,154 | A | 6/1986 | Oatman |
| 4,616,524 | A | 10/1986 | Bidoia |
| 4,622,763 | A | 11/1986 | Adams |
| 4,630,383 | A | 12/1986 | Gamm |
| 4,633,548 | A | 1/1987 | Siskind et al. |
| 4,633,599 | A | 1/1987 | Morell et al. |
| 4,638,579 | A | 1/1987 | Gamm |
| 4,640,025 | A | 2/1987 | DeRenzo |
| 4,653,204 | A | 3/1987 | Morell et al. |
| 4,660,300 | A | 4/1987 | Morell et al. |
| 4,698,922 | A | 10/1987 | Sartor |
| 4,715,094 | A | 12/1987 | Herdman |
| 4,726,126 | A | 2/1988 | Bernhard |
| 4,727,660 | A | 3/1988 | Bernhard |
| 4,766,682 | A | 8/1988 | Malloy, III |
| 4,787,124 | A | 11/1988 | Pozzobon et al. |
| 4,791,702 | A | 12/1988 | McVey |
| 4,799,297 | A | 1/1989 | Baggio et al. |
| 4,802,291 | A | 2/1989 | Sartor |
| 4,805,270 | A | 2/1989 | Kimbrough |
| 4,856,207 | A | 8/1989 | Datson |
| 4,858,282 | A | 8/1989 | DuPont, Jr. |
| 4,877,167 | A | 10/1989 | McNemar |
| 4,884,760 | A | 12/1989 | Baggio et al. |
| 4,893,419 | A | 1/1990 | Arieh et al. |
| 4,896,405 | A | 1/1990 | Simmons et al. |
| 4,937,952 | A | 7/1990 | Olivieri |
| 4,937,953 | A | 7/1990 | Walkhoff |
| 4,956,897 | A | 9/1990 | Speedie |
| 4,961,544 | A | 10/1990 | Bidoia |
| 4,967,454 | A | 11/1990 | Elieff |
| 4,969,242 | A | 11/1990 | Carlton, Sr. |
| 4,999,888 | A | 3/1991 | Miller |
| 4,999,889 | A | 3/1991 | LeCouturer |
| 5,001,817 | A | 3/1991 | De Bortoli et al. |
| 5,003,711 | A | 4/1991 | Nerrinck et al. |
| 5,012,598 | A | 5/1991 | Baggio et al. |
| 5,016,327 | A | 5/1991 | Klausner |
| 5,027,482 | A | 7/1991 | Torppey |
| 5,029,371 | A | 7/1991 | Rosenblood et al. |
| 5,042,119 | A | 8/1991 | Williams |
| 5,042,120 | A | 8/1991 | Nichols |
| 5,042,177 | A | 8/1991 | Schoch |
| 5,048,204 | A | 9/1991 | Tacchetto et al. |
| 5,067,736 | A | 11/1991 | Olson et al. |
| 5,074,013 | A | 12/1991 | Arnold et al. |
| 5,088,166 | A | 2/1992 | Lavinio |
| 5,092,614 | A | 3/1992 | Malewicz |
| 5,117,567 | A | 6/1992 | Berger |
| 5,129,130 | A | 7/1992 | LeCouturier |
| 5,131,707 | A | 7/1992 | Zazzara et al. |
| 5,152,038 | A | 10/1992 | Schoch |
| 5,157,813 | A | 10/1992 | Carroll |
| 5,158,428 | A | 10/1992 | Gessner et al. |
| 5,158,559 | A | 10/1992 | Pozzobon et al. |
| 5,170,573 | A | 12/1992 | Clinch |
| 5,171,033 | A | 12/1992 | Olson et al. |
| 5,177,882 | A | 1/1993 | Berger |
| 5,181,331 | A | 1/1993 | Berger |
| 5,189,818 | A | 3/1993 | Skaja |
| 5,190,301 | A | 3/1993 | Malewicz |
| 5,205,055 | A | 4/1993 | Harrell |
| 5,249,377 | A | 10/1993 | Walkhoff |
| 5,271,130 | A | 12/1993 | Batra |
| 5,295,315 | A | 3/1994 | Osawa et al. |
| 5,319,868 | A | 6/1994 | Hallenbeck |
| 5,319,869 | A | 6/1994 | McDonald et al. |
| 5,325,613 | A | 7/1994 | Sussman |
| 5,327,662 | A | 7/1994 | Hallenbeck |
| 5,331,752 | A | 7/1994 | Johnson et al. |
| 5,333,398 | A | 8/1994 | Seo |
| 5,341,583 | A | 8/1994 | Hallenbeck |
| 5,345,697 | A | 9/1994 | Quellais |
| 5,349,764 | A | 9/1994 | Posner |
| 5,351,420 | A | 10/1994 | Pozzobon et al. |
| 5,353,483 | A | 10/1994 | Louviere |
| 5,355,596 | A | 10/1994 | Sussman |
| 5,357,691 | A | 10/1994 | Hyde et al. |
| 5,388,315 | A | 2/1995 | Jones |
| 5,412,883 | A | 5/1995 | Wulf et al. |
| 5,421,106 | A | 6/1995 | Emrick |
| 5,425,161 | A | 6/1995 | Schoch |
| 5,463,822 | A | 11/1995 | Miller |
| 5,467,511 | A | 11/1995 | Kubo |
| 5,467,537 | A | 11/1995 | Aveni et al. |
| 5,471,769 | A | 12/1995 | Sink |
| 5,477,593 | A | 12/1995 | Leick |
| 5,485,688 | A | 1/1996 | Gorza et al. |
| 5,502,902 | A | 4/1996 | Sussman |
| 5,511,325 | A | 4/1996 | Hieblinger |
| 5,526,585 | A | 6/1996 | Brown et al. |
| 5,535,531 | A | 7/1996 | Karabed et al. |
| 5,537,763 | A | 7/1996 | Donnadieu et al. |
| 5,564,203 | A | 10/1996 | Morris |
| 5,566,474 | A | 10/1996 | Leick et al. |
| 5,566,477 | A | 10/1996 | Mathis et al. |
| D375,677 | S | 11/1996 | Gaultier |
| 5,570,522 | A | 11/1996 | Olson et al. |
| D376,041 | S | 12/1996 | Nitz |
| D377,410 | S | 1/1997 | Crowley |

| | | | |
|---|---|---|---|
| 5,606,778 | A | 3/1997 | Jungkind |
| 5,640,785 | A | 6/1997 | Egelja |
| 5,647,104 | A | 7/1997 | James |
| 5,649,342 | A | 7/1997 | D'Andrade et al. |
| 5,651,197 | A | 7/1997 | James |
| 5,651,198 | A | 7/1997 | Sussman |
| 5,671,517 | A | 9/1997 | Gourley |
| 5,675,872 | A | 10/1997 | Emery |
| 5,692,319 | A | 12/1997 | Parker et al. |
| 5,701,688 | A | 12/1997 | Crowley |
| 5,718,021 | A | 2/1998 | Tatum |
| 5,737,854 | A | 4/1998 | Sussman |
| 5,761,777 | A | 6/1998 | Leick |
| 5,765,841 | A | 6/1998 | Johnson et al. |
| 5,775,011 | A | 7/1998 | Reitano, Jr. |
| 5,778,500 | A | 7/1998 | Illingworth |
| 5,791,021 | A | 8/1998 | James |
| 5,791,068 | A | 8/1998 | Bernier et al. |
| 5,839,210 | A | 11/1998 | Bernier et al. |
| 5,848,457 | A | 12/1998 | Silagy |
| 5,853,213 | A | 12/1998 | Simpson |
| 5,873,183 | A | 2/1999 | Posner |
| 5,906,057 | A | 5/1999 | Borsoi |
| 5,909,946 | A | 6/1999 | Okajima |
| 5,913,483 | A | 6/1999 | Polk |
| 5,918,352 | A | 7/1999 | Galbreath |
| 5,934,599 | A | 8/1999 | Hammerslag |
| 5,937,542 | A | 8/1999 | Bourdeau |
| 5,946,823 | A | 9/1999 | Yates |
| 5,947,487 | A | 9/1999 | Keleny et al. |
| 5,956,823 | A | 9/1999 | Borel |
| 5,966,841 | A | 10/1999 | Barret |
| 5,971,458 | A | 10/1999 | Contreras et al. |
| 5,979,080 | A | 11/1999 | Borsoi |
| 5,983,530 | A | 11/1999 | Chou |
| 5,996,256 | A | 12/1999 | Zebe, Jr. |
| 6,000,111 | A | 12/1999 | Deskins et al. |
| 6,029,323 | A | 2/2000 | Dickie et al. |
| 6,029,375 | A | 2/2000 | Borel |
| 6,032,387 | A | 3/2000 | Johnson |
| 6,038,791 | A | 3/2000 | Cornelius et al. |
| 6,070,886 | A | 6/2000 | Cornelius et al. |
| 6,070,887 | A | 6/2000 | Cornelius et al. |
| 6,073,370 | A | 6/2000 | Okajima |
| 6,076,241 | A | 6/2000 | Borel |
| 6,102,412 | A | 8/2000 | Staffaroni |
| 6,119,318 | A | 9/2000 | Maurer |
| 6,119,372 | A | 9/2000 | Okajima |
| 6,128,801 | A | 10/2000 | Adzick et al. |
| 6,148,489 | A | 11/2000 | Dickie et al. |
| 6,202,953 | B1 | 3/2001 | Hammerslag |
| 6,219,891 | B1 | 4/2001 | Maurer et al. |
| D442,771 | S | 5/2001 | Haas |
| D442,772 | S | 5/2001 | Dietrich |
| 6,233,790 | B1 | 5/2001 | Carothers |
| 6,240,657 | B1 | 6/2001 | Weber et al. |
| 6,289,558 | B1 | 9/2001 | Hammerslag |
| 6,295,704 | B1 | 10/2001 | Rivas |
| 6,305,103 | B1 | 10/2001 | Camargo |
| 6,324,773 | B1 | 12/2001 | Gaither |
| 6,324,774 | B1 | 12/2001 | Zebe, Jr. |
| 6,327,750 | B1 | 12/2001 | Muldowney et al. |
| 6,338,186 | B1 | 1/2002 | Kleinmann |
| D453,413 | S | 2/2002 | Tsujino et al. |
| 6,357,093 | B1 | 3/2002 | Takahashi |
| 6,367,169 | B1 | 4/2002 | Barret |
| 6,378,230 | B1 | 4/2002 | Rotem et al. |
| 6,405,457 | B1 | 6/2002 | Basso et al. |
| 6,416,074 | B1 | 7/2002 | Maravetz et al. |
| 6,427,361 | B1 | 8/2002 | Chou |
| 6,457,260 | B1 | 10/2002 | Roelofs |
| 6,467,193 | B1 | 10/2002 | Okajima |
| 6,467,194 | B1 | 10/2002 | Johnson |
| 6,467,195 | B2 | 10/2002 | Pierre et al. |
| 6,473,999 | B2 | 11/2002 | Fellouhe |
| 6,502,329 | B1 | 1/2003 | Silagy |
| 6,513,211 | B1 | 2/2003 | Fisher |
| 6,532,688 | B2 | 3/2003 | Bouvier |
| 6,560,898 | B2 | 5/2003 | Borsoi et al. |
| 6,568,103 | B2 | 5/2003 | Durocher |
| 6,601,323 | B2 | 8/2003 | Tsujino et al. |
| 6,729,000 | B1 | 5/2004 | Liu |
| 6,802,439 | B2 | 10/2004 | Azam et al. |
| 6,952,890 | B1 | 10/2005 | Blakeslee |
| 7,159,340 | B2 * | 1/2007 | Borsoi ..... 36/50.1 |
| 7,281,341 | B2 | 10/2007 | Reagan et al. |
| 7,281,342 | B2 | 10/2007 | Azam et al. |
| 7,293,373 | B2 | 11/2007 | Reagan et al. |
| 7,392,602 | B2 | 7/2008 | Reagan et al. |
| 7,401,423 | B2 | 7/2008 | Reagan et al. |
| 7,409,781 | B2 | 8/2008 | Azam et al. |
| 7,735,242 | B2 * | 6/2010 | Seliger et al. ..... 36/50.5 |
| 7,908,769 | B2 * | 3/2011 | Pellegrini ..... 36/50.1 |
| 2001/0001906 | A1 | 5/2001 | Borosi |
| 2001/0002518 | A1 | 6/2001 | Morrow et al. |
| 2001/0007178 | A1 * | 7/2001 | Pierre et al. ..... 36/50.5 |
| 2001/0025434 | A1 | 10/2001 | Fellouhe |
| 2002/0002781 | A1 | 1/2002 | Bouvier |
| 2002/0046476 | A1 | 4/2002 | Snyder |
| 2002/0050076 | A1 | 5/2002 | Borsoi et al. |
| 2002/0078597 | A1 | 6/2002 | Burt |
| 2002/0083620 | A1 | 7/2002 | Tsujino et al. |
| 2002/0083621 | A1 | 7/2002 | Durocher |
| 2002/0095750 | A1 | 7/2002 | Hammerslag |
| 2002/0144435 | A1 | 10/2002 | Shepherd |
| 2002/0170205 | A1 | 11/2002 | Shepherd |
| 2002/0174570 | A1 | 11/2002 | Procter |
| 2003/0034365 | A1 * | 2/2003 | Azam et al. ..... 223/113 |
| 2003/0041478 | A1 | 3/2003 | Liu |
| 2003/0051374 | A1 | 3/2003 | Freed |
| 2003/0226284 | A1 | 12/2003 | Grande et al. |
| 2004/0078999 | A1 | 4/2004 | Freed |
| 2005/0081403 | A1 * | 4/2005 | Mathieu ..... 36/50.1 |
| 2005/0097780 | A1 | 5/2005 | Pellegrini |
| 2006/0174516 | A1 * | 8/2006 | Peruzzo ..... 36/50.5 |
| 2006/0179685 | A1 | 8/2006 | Borel et al. |
| 2007/0130799 | A1 * | 6/2007 | Seliger et al. ..... 36/50.1 |
| 2008/0235995 | A1 | 10/2008 | Reagan et al. |
| 2009/0019734 | A1 | 1/2009 | Reagan et al. |

FOREIGN PATENT DOCUMENTS

| | | |
|---|---|---|
| AT | 355771 | 3/2007 |
| DE | 8714500 | 12/1987 |
| DE | 3626837 | 2/1988 |
| DE | 3813470 | 11/1989 |
| DE | 19624553 | 1/1998 |
| DE | 19710702 | 9/1998 |
| DE | 20116755 | 2/2002 |
| DE | 10116779 | 7/2002 |
| DE | 60009019 | 12/2004 |
| DE | 202004019082 | 4/2005 |
| DE | 60033638 | 10/2007 |
| DE | 602004005134 | 12/2007 |
| EP | 0018074 | 10/1980 |
| EP | 0255869 | 2/1988 |
| EP | 0393380 | 10/1990 |
| EP | 0395536 | 10/1990 |
| EP | 0395537 | 10/1990 |
| EP | 0465222 | 1/1992 |
| EP | 0465223 | 1/1992 |
| EP | 0466459 | 1/1992 |
| EP | 0503877 | 9/1992 |
| EP | 0679346 | 11/1995 |
| EP | 0717942 | 6/1996 |
| EP | 0734662 | 10/1996 |
| EP | 0848917 | 6/1998 |
| EP | 0857501 | 8/1998 |
| EP | 0858819 | 8/1998 |
| EP | 0858821 | 8/1998 |
| EP | 0923886 | 6/1999 |
| EP | 0923965 | 6/1999 |
| EP | 0937487 | 8/1999 |
| EP | 1034712 | 9/2000 |
| EP | 1112697 | 7/2001 |
| EP | 1156723 | 11/2001 |
| EP | 1541049 | 6/2002 |
| EP | 1219195 | 7/2002 |
| EP | 1787541 | 5/2007 |

| | | |
|---|---|---|
| FR | 1182409 | 6/1959 |
| FR | 1349832 | 1/1964 |
| FR | 1404799 | 7/1965 |
| FR | 2473280 | 7/1981 |
| FR | 2689732 | 10/1993 |
| FR | 2706743 | 12/1994 |
| FR | 2770379 | 5/1995 |
| FR | 2726440 | 5/1996 |
| FR | 2752686 | 3/1998 |
| FR | 2757026 | 6/1998 |
| FR | 2766068 | 1/1999 |
| FR | 2802782 | 6/2001 |
| FR | 2802783 | 6/2001 |
| FR | 2814919 | 4/2002 |
| GB | 1010686 | 11/1965 |
| GB | 1463363 | 2/1977 |
| GB | 2041765 | 9/1980 |
| GB | 2046826 | 11/1980 |
| JP | 1124103 | 8/1989 |
| JP | 2001197905 | 7/2001 |
| JP | 2002360309 | 12/2002 |
| JP | 2003518397 | 6/2003 |
| WO | WO 9511602 | 5/1995 |
| WO | WO 9531119 | 11/1995 |
| WO | WO 9532030 | 11/1995 |
| WO | WO 9728713 | 8/1997 |
| WO | WO 9837782 | 9/1998 |
| WO | WO 9909850 | 3/1999 |
| WO | WO 9915043 | 4/1999 |
| WO | WO 0053045 | 9/2000 |
| WO | WO 0108525 | 2/2001 |
| WO | WO 0147386 | 7/2001 |
| WO | WO 02051511 | 7/2002 |
| WO | WO 2004093589 | 11/2004 |

OTHER PUBLICATIONS www.abc-of-hiking.com; Hiking Boots—Features & Characteristics; Jul. 31, 2009; 3 pages.

www.shoeguide.org; Anatomy of the Shoe; Jul. 31, 2009; 2 pages.

www.wikipedia.org; Flight Dynamics; Jul. 31, 2009; 14 pages.

* cited by examiner

FOOTWEAR LACING SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to a snowboard boot, and more particularly, to a lacing system for a snowboard boot.

The snowboard boot is an important piece of equipment for snowboarding. In particular, the snowboard boot is the user interface between the snowboard/snowboard binding and the user's foot. Typically, the snowboard binding is rigidly attached to the snowboard and has one or more straps that are disposed around the snowboard boot. The straps are tightened such that the user's foot is also rigidly attached to the snowboard. The snowboard boot must be comfortable such that the user may wear the snowboard boot and engage in the snowboarding activity for an extended period of time. To this end, snowboard boots are typically very well padded such that the pressure of the straps and the binding which is typically fabricated from metal or hard plastic parts do not pierce into the foot portion of the user. Unfortunately, the additional padding required to provide a comfortable boot also takes away from the responsiveness in maneuvering. To make left and right turns in the snowboard boot, the user applies pressure to the person's heals or toes to initiate the left and right turn. However, the padding if excessive or if the boot is too loose on the user's foot may interfere with the person's ability to apply toe or heal pressures. Any slack between the user's foot and the snowboard boot may reduce the person's ability to apply toe pressure or heal pressure to initiate the turns during snowboarding.

Another cause of slack between the snowboard boot and the user's foot is the lacing system. If the lacing system applies inadequate pressure, then the user's foot may be loose within the boot. By way of example and not limitation, the user may tighten the lace about the foot portion of the user in a tight manner. As the user laces the lace about the return elements of the snowboard boot and tightens the lace, the user must use hand strength to tighten the lace at the shin portion of the user's foot. Unfortunately, the padding must be hand compressed through the lace and is typically reaches suboptimal levels. As such, the pressure achieved at the foot portion is eventually equalized to the loose pressure achieved at the shin portion of the boot as the day wears on. As such, the user's foot may be loose within the boot and provide inadequate support to apply the appropriate toe pressures and heal pressures in effectuating left and right turns during snowboarding.

As such, there is a need in the art for an improved lacing system.

BRIEF SUMMARY

The present invention addresses the deficiencies discussed above, discussed below and those that are known in the art.

The snowboard boot may have left and right handles which each control pressures within two different zones in the boot (e.g., upper and lower shin portions and upper and lower foot portions). These zones are isolated from each other such that once the pressure is set, each of the zones or pressures within these zones are not equalized to each other but are rather maintained during a snowboarding session. A left handle may be attached to a first portion of a lace that is fed through a guide tube on the left cuff of the snowboard boot. The first portion of the lace is routed to an upper shin portion of the left and right cuffs. In particular, a first portion of the lace is routed through the guide tube, extends across the left and right cuffs, is fed through a return element, extends across the left and right cuffs and is anchored to the left cuff at an upper anchor. A second portion of the lace is fed through a guide tube at the left cuff and routed to a lower shin portion of the left and right cuffs. The second portion of the lace extends across the left and right cuffs, is fed through a return element, extends across the left and right cuffs and is fed through a return element and once again extends across the left and right cuffs and is attached to middle anchor. The left handle controls pressures within the upper and lower shin portions by pitching the handle and adjusting the amount of tension within the first and second portions of the lace.

Similarly, the right handle may be attached to third and fourth portions of the lace. The third portion of the lace may extend through a guide tube location on the right cuff, extend across the left and right cuffs, and is fed through a return element and extends across the left and right cuffs and is anchored to the middle anchor. The fourth portion of the lace may also be attached to the right handle and fed through a guide tube located on the right cuff, extend across the left and right cuffs, fed through a return element, extend across the left and right cuffs, and anchor to lower anchor. The right handle may adjust the tension within the third and fourth portions of the lace by pitching the right handle.

Once the pressures are set in the various tension zones, left and right locks may be engaged to set the pressure and prevent loosening of the lace during a snowboarding session. The handles are stored either on the tongue by clipping or inserting the handles into a pouch disposed on the tongue of the snowboard boot or clipping the handles to a back portion of the snowboard boot.

In an embodiment, a footwear for protecting a foot portion of a person is disclosed. The footwear may comprise left and right cuffs, first and second return elements attached to the right cuff, a left elongate rigid handle and a first lace. The left elongate rigid handle may define opposed first and second distal end portions wherein fingers of the person is capable of grabbing the left elongate rigid handle between the opposed first and second distal end portions.

The first lace may define first and second portions. The first portion of the lace may be fixedly attached to the first distal end portion of the left elongate rigid handle, extended across the left and right cuffs, slideably disposed through the first return element, extended across the left and right cuffs and anchored to the left or right cuff thereby defining a first tightening zone. The second portion of the first lace may be fixedly attached to the second distal end portion of the left elongate rigid handle, extended across the left and right cuffs, slideably disposed through the second return element, extended across the left and right cuffs and anchored to the left or right cuff thereby defining a second tightening zone.

The person may pull on the left handle to tighten the lace and the left and right cuffs about the foot portion of the person. The person may also rotate or pitch the elongate rigid handle to produce uneven tightness or pressure in the first and second tightening zones such that the left handle controls tightness or pressures in two zones.

The footwear may further comprise third and fourth return elements attached to the left cuff, a right elongate rigid handle and a second lace. The right elongate rigid handle may define opposed first and second distal end portions wherein fingers of the person is capable of grabbing the right elongate rigid handle between the opposed first and second distal end portions of the right elongate rigid handle.

The second lace may define first and second portions. The first portion of the second lace may be fixedly attached to the first distal end portion of the right elongate rigid handle, extended across the left and right cuffs, slideably disposed through the third return element, extended across the left and right cuffs and anchored to the left or right cuff thereby defining a third tightening zone. The second portion of the second lace may be fixedly attached to the second distal end portion of the right elongate rigid handle, extended across the left and right cuffs, slideably disposed through the fourth return element, extended across the left and right cuffs and anchored to the left or right cuff thereby defining a fourth tightening zone.

The first and second portions of each of the first and second laces may be separate pieces. The first and second portions of each of the first and second laces may also be one unitary piece. The return elements may be curved hollow tubes. The return elements may be embedded within the left and right cuffs.

In another embodiment, a footwear for protecting a foot portion of a person is disclosed. The footwear may comprise left and right cuffs, first and second return element attached to the left cuff, an elongate rigid handle and a lace. The elongate rigid handle may define opposed first and second distal end portions wherein fingers of the person is capable of grabbing the handle between the opposed first and second distal end portions.

The lace with the elongate rigid handle may be attached to the lace. The lace may be laced through the return elements for tightening the left and right cuffs about the foot portion of the person. The lace may define first and second portions. The first portion of the lace may be fixedly attached to the first distal end portion of the handle, extended across the left and right cuffs, slideably disposed through the first return element, extended across the left and right cuffs and anchored to the left or right cuff thereby defining a first tightening zone. The second portion of the lace may be fixedly attached to the second distal end portion of the handle, extended across the left and right cuffs, slideably disposed through the second return element, extended across the left and right cuffs and anchored to the left or right cuff thereby defining a second tightening zone.

The person may pull on the handle to tighten the lace and the left and right cuffs about the foot portion of the person. The person may rotate or pitch the elongate rigid handle to produce uneven tightness in the first and second tightening zones such that the one elongate rigid handle controls tightness or pressure in two zones.

In another embodiment, a snowboard boot for protecting a foot portion of a person is disclosed. The snowboard boot may comprise left and right cuffs, a back portion, a tongue, a plurality of return elements and left and right handles. The back portion may be attached to the left and right cuffs and disposed between the left and right cuffs. The tongue may be disposed at a forward portion of the snowboard boot and between the left and right cuffs. The plurality of return elements may be attached to the left and right cuffs. The lace may be laced through the return elements. The left and right handles may be attached to the lace for tightening the lace and the left and right cuffs about the foot portion of the person. The left and right handles may be attached to the tongue or back portion after the lace is tightened.

The left and right handles may have clips for clipping the left and right handles to the back portion or the tongue after the lace is tightened. Handle portions of the left and right handles may be disposed on an interior side of the tongue and the clips may be disposed on an exterior side of the tongue. The snowboard boot may further comprise a pouch attached to the tongue for storing the left and right handles after the lace is tightened.

The lace may define first and second separate pieces. The first piece of the lace may be attached to the left handle. The second piece of the lace may be attached to the right handle.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Referring now to the figures, a snowboard boot 10 is shown. The snowboard boot 10 may have two handles 12*a, b* for tightening the boot 10 about a foot portion of a person. Each handle 12*a, b* controls tension within two zones 14*a, b* (see FIG. 1) or 16*a, b* (see FIG. 2). As such, the tension of the lace 18 can be adjusted in four zones 14*a, b*, 16*a, b*. The four different zones of tension adjustment 14*a, b*, 16*a, b* provide greater comfort to the user since the user can adjust the tension in different zones based on the unique foot configuration of the user. The user may tighten the upper shin to a different tension compared to the lower shin. Also, the person or user may tension the upper foot portion to a different tension compared to the lower foot portion. Based on the user's unique foot configuration, the tension of the boot 10 and various zones 14*a, b*, 16*a, b* may be adjusted.

Figure 1:
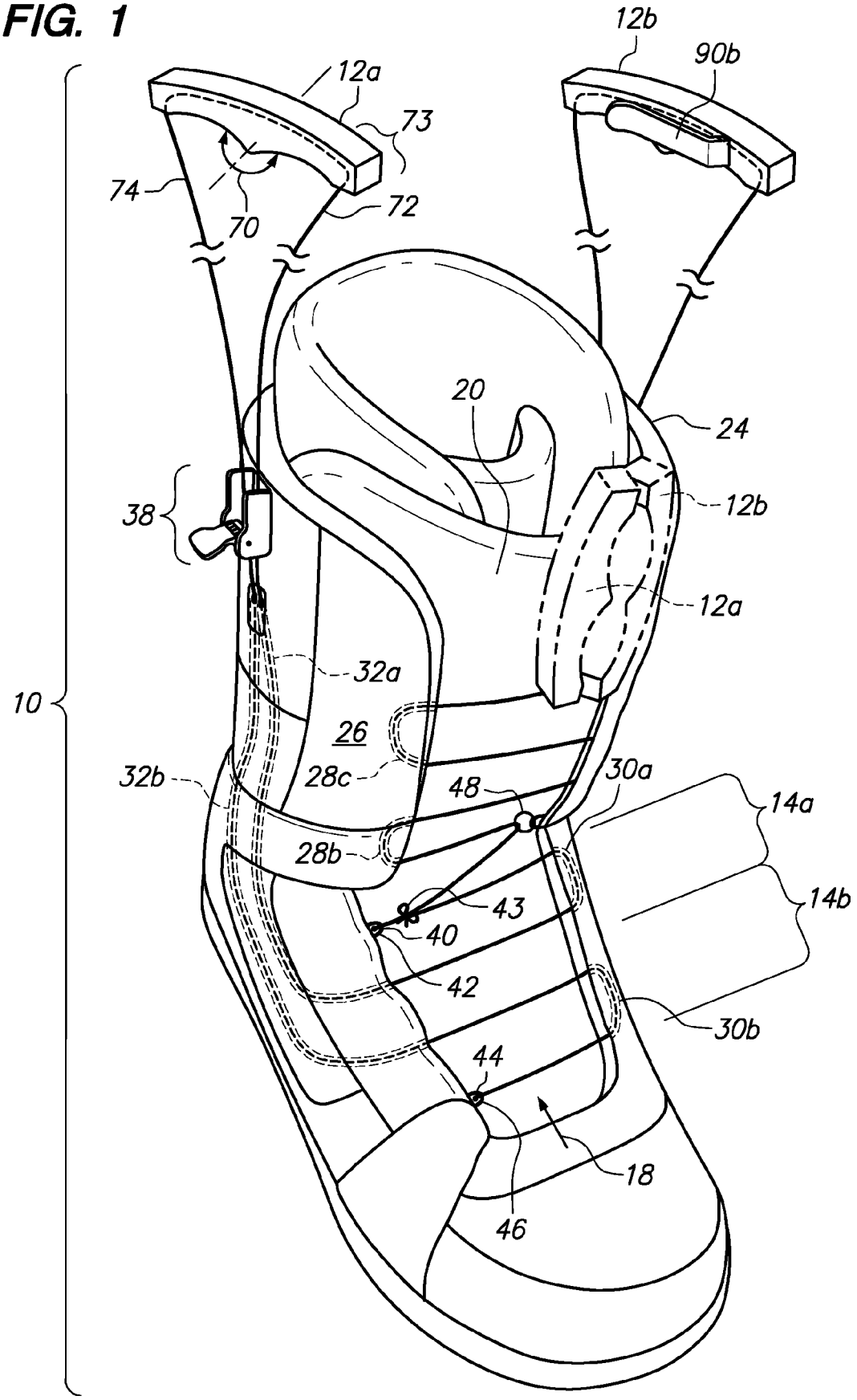
FIG. 1 is a right perspective view of a snowboard boot.
Figure 2:
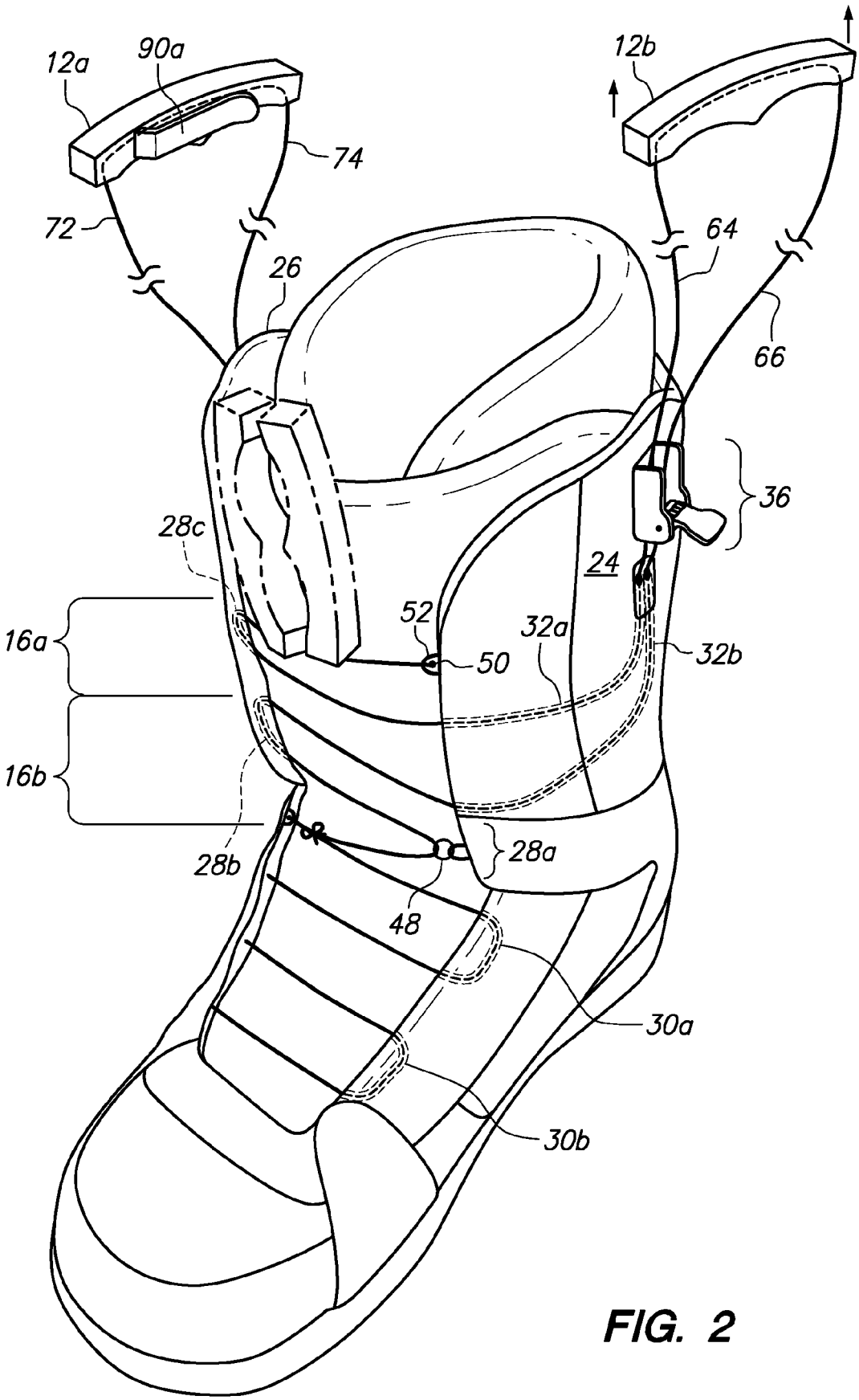
FIG. 2 is a left perspective view of the snowboard boot shown in FIG. 1.
Figure 3:
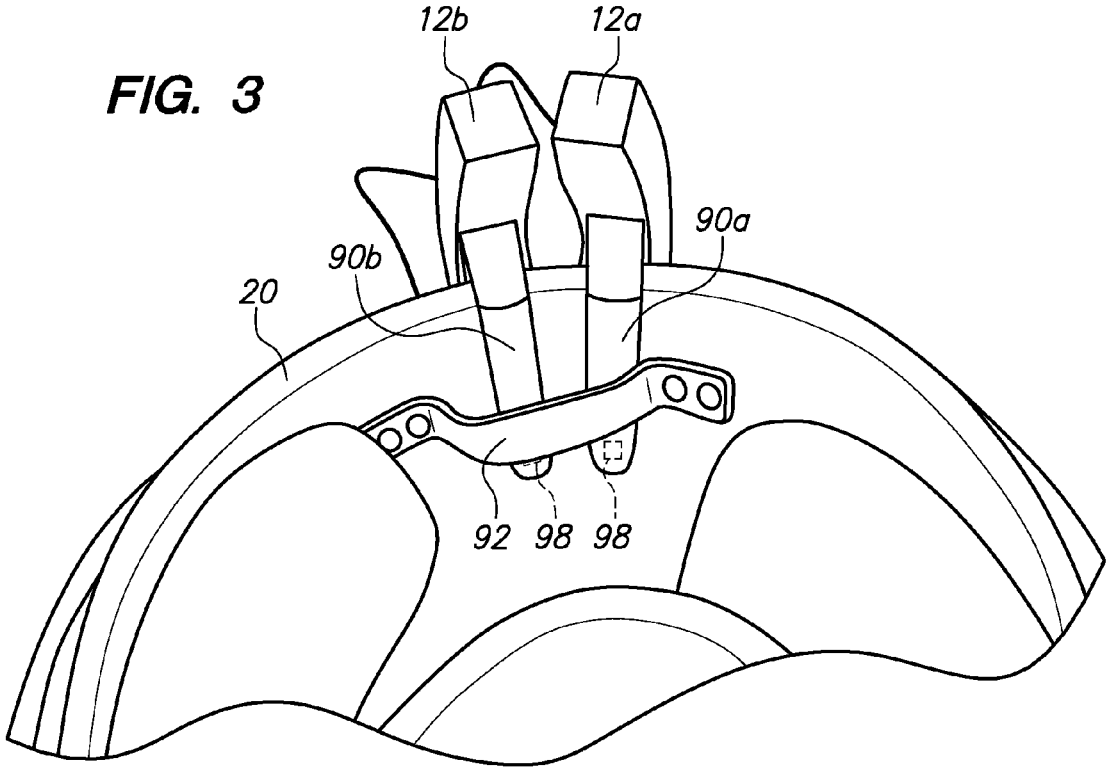
FIG. 3 illustrates left and right handles clipped to a tongue of the snowboard boot shown in FIG. 1.
Figure 4:
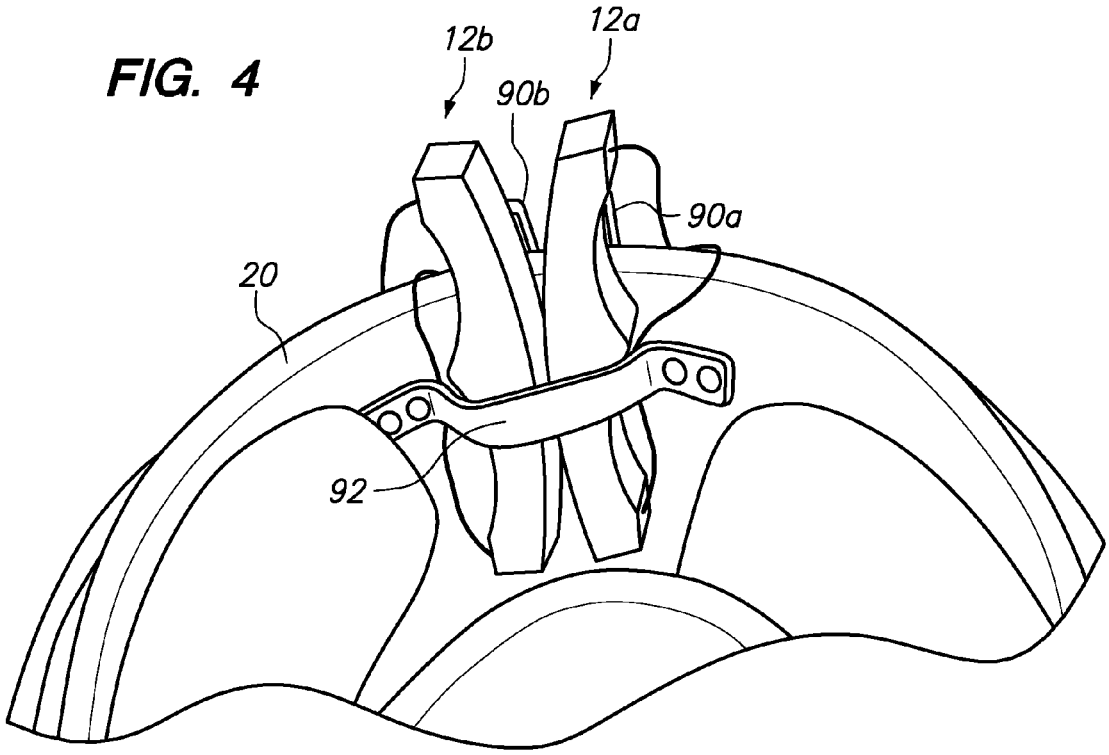
FIG. 4 illustrates left and right handles clipped to the tongue of the snowboard boot in reverse compare to the illustration shown in FIG. 3.
Figure 5:
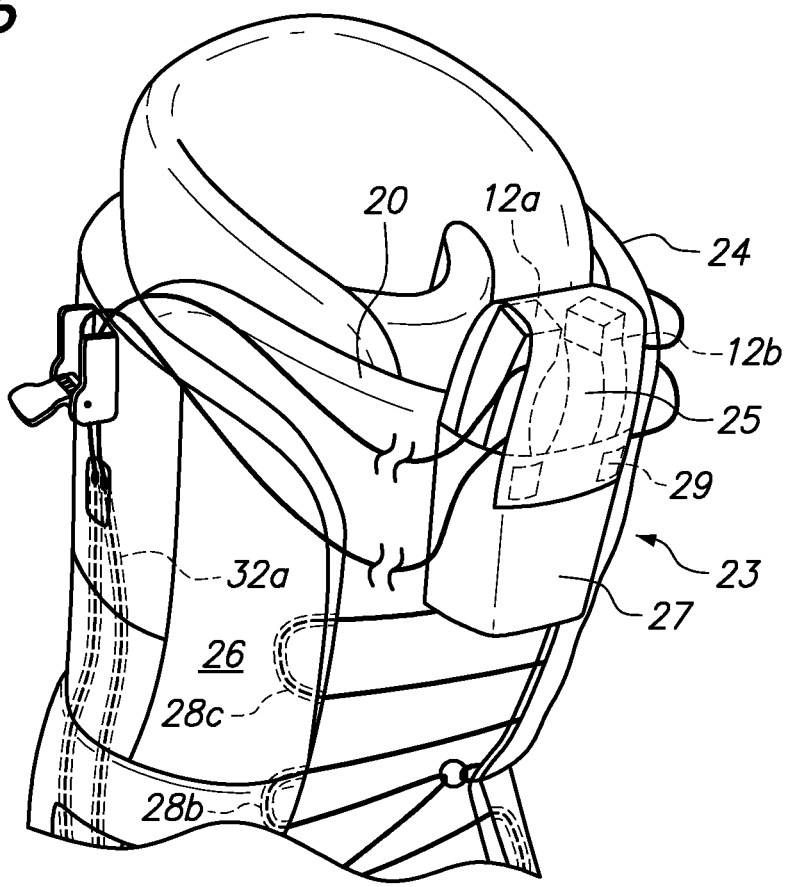
FIG. 5 illustrates handles stored within a pouch attached to the tongue of the snowboard boot.
Figure 6:
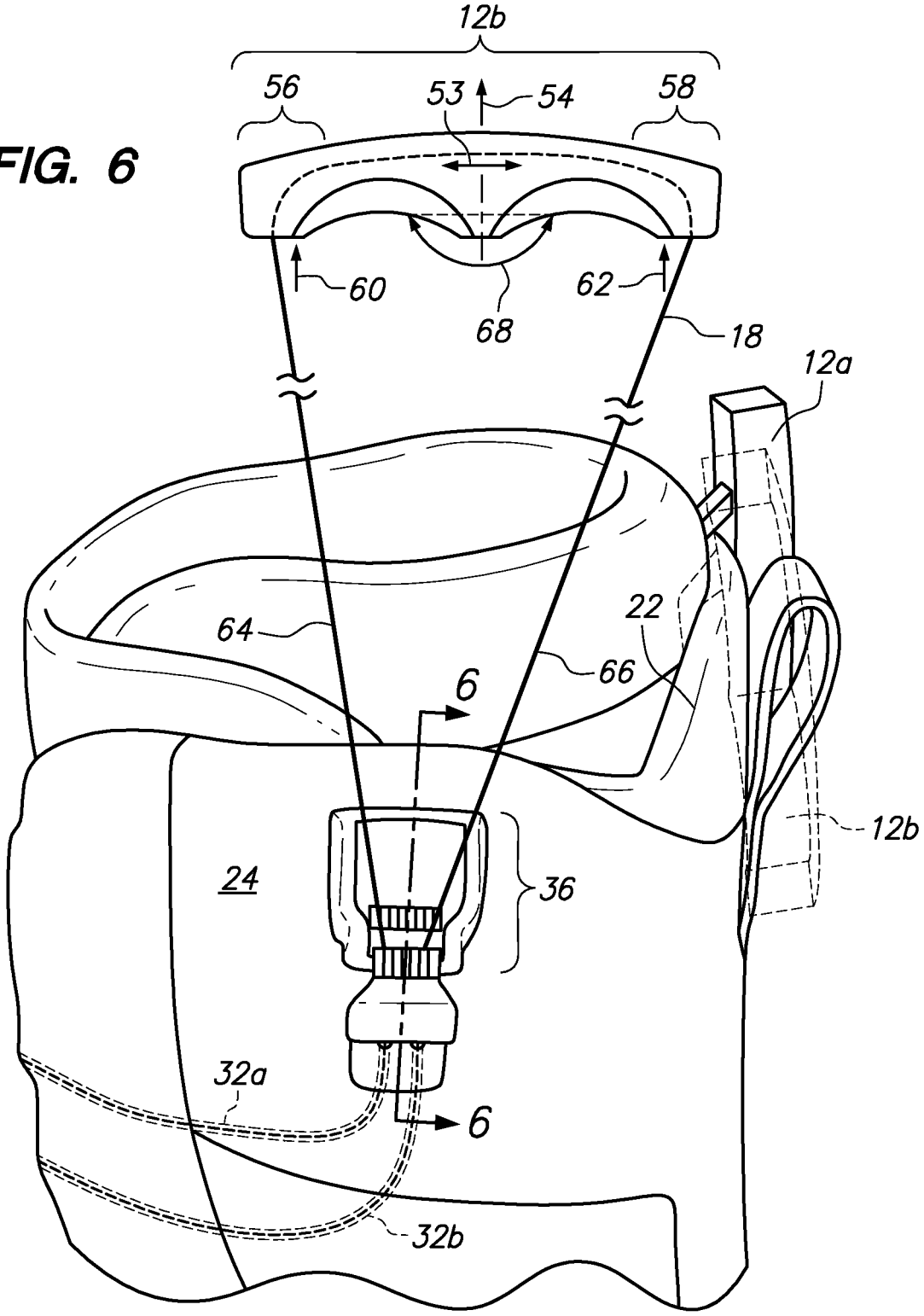
FIG. 6 is a left side view of the snowboard boot shown in FIG. 1.

The figures also illustrate that the handles 12*a, b* may be stored on the front tongue 20 (see FIGS. 1-5) or on a back portion 22 (see FIG. 6). The handles 12 may be clipped to the tongue 20 as shown in FIGS. 1-3 or stored in a pouch 23 as shown in FIG. 5. Additionally, the handles 12*a, b* may be clipped to the back portion 22 as shown in FIG. 6. The clip or pouch provides for a convenient location to store the handle during a snowboarding session.

More particularly, the boot 10 may comprise left and right cuffs 24, 26 (see FIGS. 1 and 2). The tongue 20 may be disposed under the left and right cuffs 24, 26 and may provide comfort when the lace 18 is tightened. Each of the left and right cuffs 24, 26 may have one or more return elements 28*a,*

*b, c*, 30*a, b*. By way of example and not limitation, the left cuff 24 may have return elements 28*a*, 30*a* and *b* as shown in FIG. 2. The right cuff 26 may have return elements 28*b, c* as shown in FIGS. 1 and 2. Each of the left and right cuffs 24, 26 may also have guide tubes 32*a, b* and 34*a, b* as shown in FIGS. 1 and 2 which route the lace 18 from a forward portion of the left and right cuffs 24, 26 to left and right locks 36, 38 (see FIGS. 1 and 2).

The snowboard boot 10 may be laced with a single lace 18. In particular, the lace 18 may be anchored to the right cuff 26 at point 40 (see FIG. 1). In particular, the right cuff 26 may have a webbing, loop or middle anchor 42 through which the lace 18 may be inserted. The lace 18 may then be tied in a knot 43 such that the lace 18 cannot slide through the middle anchor 42. A lower portion of the lace 18 may be extended across the left and right cuffs 24, 26 and fed through the return element 30*a*. The lace 18 may be extended back across the left and right cuffs 24, 26 and fed through guide tube 32*a* and passed through right lock 38 and into the handle 12*a*. This defines tightening zone 14*a* at the upper foot portion. The lace 18 may be retraced back to the boot 10 through guide tube 32*b* and extended across the left and right cuffs 24, 26. The lace 18 may be fed through return element 30*b* and anchored to the right cuff 26 at point 44. In particular, the lace 18 may be tied to a webbing loop or lower anchor 46 attached to the right cuff 26. This defines tightening zone 14*b* at the lower foot portion.

The upper portion of the lace 18 may extend across the left and right cuffs 24, 26 and loop through return element 28*a* or ring 48, as shown in FIG. 2. The return element 28*a* may be a hollow curved plastic tube or ring 48 attached to the left cuff 24. The lace 18 may be extended across the left and right cuffs 24, 26 and fed through return element 28*b*. The lace 18 may then be returned across the left and right cuffs 24, 26 and fed through guide tube 32*b*. The lace 18 may be fed through left lock 36 and handle 12. This defines tightening zone 16*b* at a lower shin portion. The lace 18 may be retraced back to the left and right cuffs 24, 26 through guide tube 32*a*. The lace 18 may then be extended across the left and right cuffs 24, 26 and fed through return element 28*c*. The lace 18 may then be extended across the left and right cuffs 24, 26 and anchored to point 50. By way of example and not limitation, the lace 18 may be tied to a webbing or loop or upper anchor 52 attached to the left cuff 24. This defines tightening zone 16*a* at an upper shin portion. Accordingly, two handles 12*a, b* control four different isolated zones 14*a, b* and 16*a, b*.

Referring now to FIG. 6, the left lock 36 on the left cuff 24 is shown. The lace 18 is fed through guide tubes 32*a, b*, through left lock 36 and to handle 12*b*. The lace 18 may be fed through the handle 12*b*. The lace 18 may slide within the handle 12*b* as shown by arrows 53. However, when the handle 12*b* is being pulled upwardly as shown by arrow 54 in FIG. 6, the lace 18 cannot slide within the handle 12*b*. The lace 18 is fixedly attached to the handle 12*b*.

As the person pulls on the handle 12*b*, the person may apply more or less upward pressure on the first or second distal end portions 56, 58 of the handle 12*b*. This is shown by arrows 60, 62. When greater pressure is applied to the first distal end portion 56 of the handle 12*b*, a first portion 64 (see FIG. 6) of the lace 18 is tensioned. This provides additional tension in the tightening zone 16*a* (see FIG. 2). When additional pressure is applied to the second distal end portion 58 of the handle 12*b*, a second portion 66 of the lace 18 is tensioned. This provides additional tensioning in the tightening zone 16*b* (see FIG. 2). By pitching the handle 12*b* as shown by rotational arrow 68 in FIG. 6, different tensions may be applied to the first and second portions 64, 66 of the lace 18 such that different tensions may be achieved in the tightening zones 16*a, b*. When the correct amount of tension is achieved in the tightening zone 16*a, b*, the left lock 36 may be engaged to set the tension in the tightening zone 16*a, b*.

The handle 12*a* (see FIG. 1) controls the tension within tightening zones 14*a, b*. Similar to the handle of 12*b*, the handle 12*a* may be pitched as shown by rotational arrow 70 (see FIG. 1). When the handle 12*a* is pitched in the counterclockwise direction, more tension is placed in portion 72 of the lace 18. This provides additional tension in tightening zone 14*a*. When the handle 12*a* is pitched in the clockwise direction, additional tension is placed in portion 74 of the lace 18. This provides additional tension in the tension tightening zone 14*b*. When the proper amount of tension is placed in the tightening zones 14*a, b*, right lock 38 is then engaged to set the tension in the tightening zones 14*a, b*.

Figure 7:
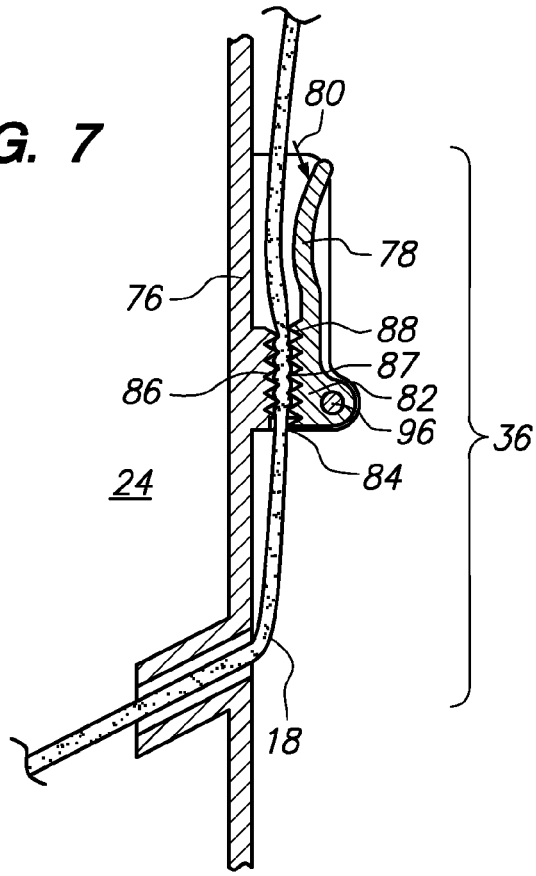
FIG. 7 is a cross sectional view of a lock shown in FIG. 6 in a locked position.
Figure 8:
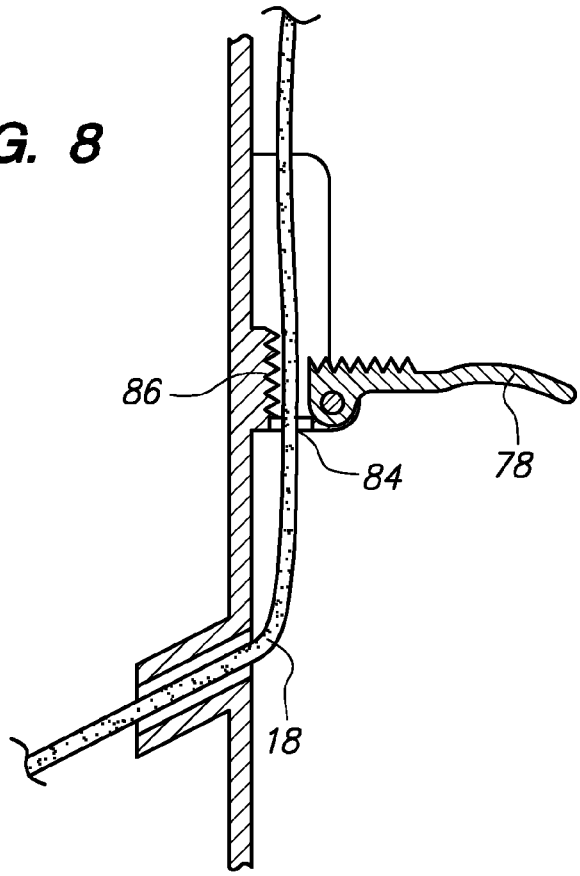
FIG. 8 is a cross sectional view of the lock shown in FIG. 6 in an unlocked position.

The operation of the left and right locks 36, 38 will now be described. The left lock 36 is shown in FIGS. 7 and 8. The right lock 38 has the same structure as left lock 36. The left lock 36 may have a base plate 76 that is attached to the left cuff 24. The left lock 36 may have a handle 78 which is curved away from the base plate 76 such that a thumb or finger of the person may be wedged between the handle 78 and the base plate 76 and be able to push down on the handle 78 as shown by arrow 80. When the handle 78 is pushed down, a cam 82 is rotated in the clockwise direction. A lower point 84 of the gripping surface 87 initially squeezes the lace 18 then releases the lace 18, as shown in FIG. 8. To engage the left lock 36, the handle 78 is lifted or rotated in the counterclockwise direction until the gripping surfaces 86 and 87 frictionally engage the lace 18. Initially, the lower point 84 presses against the lace 18. As the handle 78 is further rotated in the counterclockwise direction, the lower point 84 squeezes the lace 18 and may partially deflect the base plate 76. Once the lower point 84 extends past a plane perpendicular to the base plate 76 and intersecting the rotating axis 96, the handle is now urged toward the base plate 76. Since the lace 18 is tensioned, the lace 18 pulls down and urges the cam 82 in the counterclockwise direction. The upper point 88 of the gripping surface 87 cannot be rotated any further. The upper point 88 of the gripping surface 87 further engages the lace 18 to tighten its grip on the lace 18 and prevent any loosening of the tension in zones 16*a, b*.

Referring now to FIG. 1, after the lace 18 has been properly tensioned, the handles 12*a, b* may be attached to the tongue 20 of the snowboard boot 10. In particular, the handles 12*a, b* may have a clip 90*a, b* that allows a user to clip the handles 12*a, b* to the tongue 20. A strap 92 (see FIG. 3) may be provided on the tongue 20 to further hold the handles 12*a, b* on the tongue 20 and provide an intuitive indication that the handles 12*a, b* belong on the tongue 20. The handles 12*a, b* may be oriented in a vertical direction. The clips 90*a, b* may be inserted between the strap 92 and the tongue 20 as shown in FIG. 3. The clips 90*a, b* may also have a barb 98 on its distal end portion to retain the handles 12*a, b* on the tongue 20. The clips 90*a, b* are shown as being disposed on an interior side of the tongue 20 with the handle portion being disposed on an exterior side of the tongue 20. However, it is also contemplated that the handles 12*a, b* may be disposed on the tongue 20 in a reverse manner. In particular, the handle portions of the handles 12*a, b* may be disposed on the interior side of the tongue 20 and the clips 90*a, b* of the handles 12*a, b* may be disposed on the exterior side of the tongue 20, as shown in FIG. 4. The handle portions of the handle 12*a, b* may be inserted between the strap 92 and the tongue 20.

Alternatively, as shown in FIG. 5, the handles 12*a, b* may be stored in a pouch 94 formed or attached to the tongue 20. The pouch 23 may have a flap 25 that is removably attachable to a body 37 of the pouch 23 via hooks and loops 29. Alternatively, as shown in FIG. 6, the handles 12*a, b* may be clipped to the back portion 22 of the snowboard boot 10.

During use, to wear the boot 10, the locks 36, 38 are traversed to the unlocked position (see FIGS. 1 and 2). The lace 18 is loosened such that there is no tension in the tightening zones 14*a, b* and 16*a, b*. The tongue 20 is pushed forward to allow more space for the foot of the person to be inserted into the snowboard boot 10. After the foot of the person is inserted into the snowboard boot 10, the person may grab the left and right handles 12*b*, a with his/her left and right hands, respectively. The user may then pull upward on the handles 12*a, b* while pushing downward with his/her foot to remove any slack of the lace 18 from the tightening zones 14*a, b* and 16*a, b*. The tongue 20 is moved backward and seated on the shin of the user. The user may now grab the right handle 12*a* with his/her right hand. The user pulls upward on the right handle 12*a* while pushing downward with his/her foot. This tightens the tightening zones 14*a, b* which affects the pressure applied to the upper and lower foot portions of the user. The user can pitch the handle 12*a* in the direction of rotational arrow 70 (see FIG. 1) to apply more or less pressure in tightening zone 14*a* as compared to tightening zone 14*b*. Once the desired amount of pressure is achieved in the tightening zones 14*a, b*, the user reaches down with his/her left hand and traverses the lock 38 to the engaged position (see FIG. 7). In particular, the user flips the handle 78 upward thereby pinching the lace 18 between the gripping surface 86 and the gripping surface 87 and more particularly the upper point 88 of the gripping surface 87. The tension in the lace 18 urges the cam 82 in rotation such that the upper point 88 of the cam 82 pinches into the lace 18 and further increases the resistance to loosening of the lace 18. This procedure sets the pressure in the tightening zones 14*a, b* and the pressure applied to the foot portion of the user. Additionally, once the lock 38 is traversed to the locked position, the individual pressure set in the tightening zone 14*a* and the pressure set in the tightening zone 14*b* do not equalize. Rather, they are isolated from each other such that there remains a pressure differential, if so adjusted.

The following procedure sets the pressure in the shin portion of the user. In particular, the user grabs the left handle 12*b* with his/her left hand. The user pulls upward on the left handle 12*b* while pushing downward with his/her foot. The pressure in the shin portion increases due to the tension in the lace 18. The user pitches the handle 12*b* as shown in FIG. 6 in the direction of rotational arrow 68 to apply more or less pressure in the tightening zone 16*a* and the tightening zone 16*b* (see FIG. 2). Once the desired amount of pressure in the tightening zones 16*a, b* are achieved, the lock 36 is traversed to the locked position with the person's right hand. The pressure set in the tightening zone 16*a* is isolated from the pressure set in the tightening zone 16*b*. As such, the pressure in these zones 16*a, b* do not equalize but rather are maintained throughout use of the boot 10 or during the snowboarding session.

After the pressures within the tightening zones 14*a, b*, 16*a, b* are set, the handles 12*a, b* may be stored. In one embodiment, the handles 12*a, b* are stored on the tongue 20 of the snowboard boot 10 (see FIG. 1). The handles 12*a, b* may have clips 90*a, b* (see FIGS. 1 and 2) which are clipped to the tongue 20 and received within the strap 92 (see FIG. 3) sewn to the interior surface of the tongue 20 (see FIG. 3). Moreover, the clips 90*a, b* may have barbs 98 to mitigate against accidental removal of the handles 12*a, b* from the tongue 20. In a second embodiment, the handles 12*a, b* may be clipped to the back portion of the snowboard boot 10, as shown in FIG. 6. Alternatively, the handles 12*a, b* may be stored in a pouch 94 (see FIG. 5) disposed on a front portion of the tongue 20.

It is also contemplated that the snowboard boot 10 may be laced with multiple laces. By way of example and not limitation, lace portion 72 may be secured to a first distal end portion 73 of the handle 12*a* and not fed through the handle 12*a* to lace portion 74. The lace portion 72 may be attached to the first distal end portion 73 of the right handle 12*a* by various means known in the art (e.g., knot, etc.) or developed in the future. The lace portion 72 is routed as discussed above and anchored to point 40 via middle anchor 42. Similarly, the lace portion 74 may be attached to the second distal end portion 75 of the right handle 12*a* and fed through the guide tube 32*b* and return element 30*b* and anchored to point 44 via lower anchor 46. Referring now to FIGS. 2 and 6, the lace portion 64 may be attached to first distal end portion 56 of the left handle 12*b*, laced to the boot 10 and anchored to point 50 via upper anchor 52. The lace portion 66 may be attached to second distal end portion 58 of the left handle 12*b* and laced to the snowboard boot 10 and anchored to the middle anchor 42 and point 40 (see FIG. 1). Each of the lace portions 72, 74 and 66, 64 may be individual laces and not one continuous lace.

It is also contemplated that different configurations of the tightening zones 14*a, b* and 16*a, b* may be configured on the snowboard boot 10. By way of example and not limitation, the right handle 12*a* may control pressures within tightening zones 16*a, b*, and the left handle 12*b* may control pressures within the tightening zones 14*a, b*. Alternatively, the right handle 12*a* may control pressures at both the shin portion and foot portion of the user. The portion 72 of the lace 18 may be routed by a guide tube to the shin portion and not the upper foot portion as shown in FIG. 1. The portion 74 of the lace 18 may still extend to the foot portion as shown in FIG. 1. By this means, the right handle 12*a* may control tightening zones located in the shin portion as well as the foot portion. Similarly, the left handle 12*b* may control pressure within the shin portion and the foot portion of the user. The portion 66 of the lace 18 may be routed to the upper foot portion via a guide tube instead of the lower shin portion as shown. In this example, the left and right handles 12*a, b* control pressures within various areas of the foot and shin portions of the user.

The above description is given by way of example, and not limitation. Given the above disclosure, one skilled in the art could devise variations that are within the scope and spirit of the invention disclosed herein, including various ways of positioning the various tightening zones 14*a, b*, 16*a, b*. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A footwear for protecting a foot portion of a person, the footwear comprising:

left and right cuffs defining first, second, third and fourth lacing regions, each of the first, second, third and fourth lacing regions being separate and independently tightenable from each other, the first and second lacing regions being independently tightened by a first elongate rigid handle, the third and fourth lacing regions being independently tightened by a second elongate rigid handle;

first and second return elements attached to one of the left cuff or the right cuff at the first and second lacing regions;

the tint elongate rigid handle defining opposed first and second distal end portions wherein fingers of the person grabs the first elongate rigid handle between the opposed first and second distal end portions;

a lace defining first and second portions, the first portion of the lace being attached to the first distal end portion of the first elongate rigid handle laud to the left and right cuffs with the first return element at the first lacing region and fixedly attached to one of the left and right cuffs wherein the first elongate rigid handle independently tightens the first lacing region, and the second portion of the first lace being attached to the second distal end portion of the first elongate rigid handle laced to the left and right cuffs with the second return element at the second lacing region and fixedly attached to one of the left and right cuffs wherein the first elongate rigid handle independently tightens the second lacing region by pitching the first elongate rigid handle;

third and fourth return elements attached to the other one of the left cuff or right cuff at the third and fourth lacing regions;

the second elongate rigid handle defining opposed first and second distal end portions wherein fingers of the person grabs the second elongate rigid handle between the opposed first and second distal end portions of the second elongate rigid handle;

the lace defining third and fourth portions, the third portion of the lace being attached to the first distal end portion of the second elongate rigid handle laced to the left and right cuffs with the third return element at the third lacing region and fixedly attached to one of the left and right cuffs wherein the second elongate rigid handle independently tightens the third lacing region, and the fourth portion of the lace being fixedly attached to the second distal end portion of the second elongate rigid handle laced to the left and right cuffs with the fourth return element at the fourth lacing region and fixedly attached to one of the left and right cuffs wherein the second elongate rigid handle independently tightens the fourth lacing region by pitching the second elongate rigid handles;

wherein the person pulls on the first handle to tighten the first and second portions of the lace at the first and second lacing regions, and pitching the first elongate rigid handle regulates tightness of the first and second portions of the face in the first and second lacing regions;

wherein the person pulls on the second handle to tighten the third and fourth portions of the lace at the third and fourth lacing regions, and pitching the second elongate rigid handle regulates tightness of the third and fourth portions of the lace in the first and second lacing regions.

2. The footwear of claim 1 wherein the first, second, third and fourth portions of the lace are unitary.

3. The footwear of claim 1 wherein the return elements are curved hollow tubes.

4. The footwear of claim 1 wherein the return elements are embedded within the left and right cuffs.

5. A footwear for protecting a foot portion of a person, the footwear comprising:

left and right cuffs defining first, second, third and fourth tightening zones being separate and independent from each other, the first and second tightening zones being independently tightened by a first elongate rigid handle, the third and fourth tightening zones being independently tightened by a second elongate rigid handle;

first and second return element attached to the left cuff;

third and fourth return elements attached to the right cuff;

an elongate rigid right handle defining opposed first and second distal end portions wherein fingers of the person's right hand grabs the right handle between the opposed first and second distal end portions of the right handle;

an elongate rigid left handle defining opposed first and second distal end portions wherein fingers of the person's left hand grabs the left handle between the opposed first and second distal end portions of the right handle;

a lace with the elongate rigid right handle attached to the lace, the lace laced through the first and second return elements for tightening the left and right cuffs about a foot portion of the person, the lace defines first and second portions, the first portion of the lace being fixedly attached to the first distal end portion of the handle, extended across the left and right cuffs, slideably disposed through the first return element, extended across the left and right cuffs and anchored to the left or right cuff thereby defining the first tightening zone, and the second portion of the lace being fixedly attached to the second distal end portion of the handle, extended across the left and right cuffs, slideably disposed through the second return element, extended across the left and right cuffs and anchored to the left or right cuff thereby defining the second tightening zone independently tightened from the first tightening zone;

the elongate rigid left handle attached to the lace, the lace laced through the third and fourth return elements for tightening the left and right cuffs about a shin portion of the person, the lace defines third and fourth portions, the third portion of the lace being fixedly attached to the first distal end portion of the handle, extended across the left and right cuffs, slideably disposed through the third element, extended across the left and right cuffs and anchored to the left or right cuff defining the third tightening zone, and the fourth portion of the lace being fixedly attached to the second distal end portion of the left handle, extended across the left and right cuffs, slideably disposed through the fourth return element, extended across the left and right cuffs and anchored to the left or right cuff thereby defining the fourth tightening zone independently tightened from the third tightening zone;

wherein the person pulls on the right handle to tighten the lace and the left and right cuffs about the foot portion of the person, and pitching the elongate rigid right handle produces uneven tightness in the first and second tightening zones such that the one elongate rigid right handle controls tightness in two zones;

wherein the person pulls on the left handle to tighten the lace and the left and right cuffs about the shin portion of the person, and pitching the elongate rigid left handle produces uneven tightness in the third and fourth tightening zones such that the one elongate rigid left handle controls tightness in two zones.

* * * * *